United States Patent [19]

Chatenay épouse

[11] Patent Number: 4,854,092

[45] Date of Patent: Aug. 8, 1989

[54] MOBILE STRUCTURE FOR MEETING HALLS OR AUDITORIUMS

[76] Inventor: Catherine M. Chatenay épouse Compagnone, 70 Rue Mouffetard, 75005 Paris, France

[21] Appl. No.: 125,362

[22] Filed: Nov. 25, 1987

[30] Foreign Application Priority Data

Dec. 3, 1986 [FR] France ..... 86 16913

[51] Int. Cl.[4] ..... E04H 3/12

[52] U.S. Cl. ..... 52/10; 52/6; 52/9

[58] Field of Search ..... 52/6, 7, 9, 10

[56] References Cited

U.S. PATENT DOCUMENTS

| | | | |
|---|---|---|---|
| 268,154 | 11/1882 | Underhill | 52/10 |
| 619,153 | 2/1899 | Egan | 52/10 |
| 3,092,876 | 6/1963 | Cornberg | 52/9 |
| 4,207,713 | 6/1980 | Chatenay | 52/9 |
| 4,633,625 | 1/1987 | Dieban | 52/6 |

FOREIGN PATENT DOCUMENTS

| | | | |
|---|---|---|---|
| 370166 | 2/1923 | Fed. Rep. of Germany | 52/7 |
| 860408 | 12/1952 | Fed. Rep. of Germany | 52/7 |
| 1213590 | 3/1966 | Fed. Rep. of Germany | 52/10 |
| 3309203 | 9/1984 | Fed. Rep. of Germany | 52/7 |
| 552824 | 5/1923 | France | 52/7 |
| 2135590 | 9/1984 | United Kingdom . | |

*Primary Examiner*—Henry E. Raduazo

*Attorney, Agent, or Firm*—Fisher, Christen & Sabol

[57] ABSTRACT

A modifiable floor structure useful in optimizing the configuration of a public hall is disclosed. The floor structure comprises a plurality of modular platforms, each including a rectangular horizontal panel, a pair of box girders, each box girder having a plurality of housings suitable for enclosing a plurality of folded chairs. Each modular platform also includes a mechanism for elevating and lowering the platform which is adapted such that the modular platform remains level and parallel to the ground as it is raised and lowered. A mechanism for remotely controlling the operation of the elevating mechanism is also included whereby the configuration of a plurality of modular platforms may be controlled from a central location. The seats stored within the housings of the modular platforms may be elevated, thereby positioning them for use above the plane of the modular platform. Furthermore, the seats may is configured in a variety of ways.

11 Claims, 9 Drawing Sheets

47
48
46
40
43
49
44
42
45
12
13
1
3
11
13'
12'
14
14'
10
2
2'
8
6

MOBILE STRUCTURE FOR MEETING HALLS OR AUDITORIUMS

BACKGROUND OF THE INVENTION

1. Field of the Invention

The present invention relates to a structure forming a modifiable flooring, particularly for a hall or premises intended for public meetings or for collective use, such as meeting halls or auditoriums.

The floor structure according to the invention may be adapted to different uses of collective nature.

2. Prior Art

There is a need, resulting from the development of leisure and cultural activities, for halls or rooms intended for collective meetings or for all types of public events.

Presently existing meeting halls or the like each respond to characteristics determined by the functional needs, themselves dependent on the specific conditions of each type of activity or event concerned.

BROAD DESCRIPTION OF THE INVENTION

It is an object of the invention to provide halls or premises for various and multiple purposes and consequently presenting a flexible structure adaptable to every different use, in a limited period of time, with the result that the conversion may be effected rapidly between two types of events.

In particular, it is desirable to be able to pass, rapidly and without manpower costs, from a totally open structure which allows free circulation of people, and even vehicles, to a totally different structure where seats must be arranged for a meeting in which the participants are sitting down and and watching an event (theatre plays, concerts, conferences, indoor sports events, . . . ).

To that end, the invention relates to a modifiable floor structure, particularly for a public hall or premises for collective use, said structure being characterized in that it comprises a plurality of modular platforms, each including a horizontal panel which may be disposed such that a flat, low floor surface is provided; on the one hand, the modular platforms are each also provided with mechanical means adapted to ensure the vertical displacement of said platform whilst maintaining the level and parallel relationship between the platform and the ground. The displacement means is preferably associated with remote control means for controlling the movement of the platform from a central station. The platform also includes a housing for containing at least one and preferably a plurality of seats in folded position. When the seats are folded and stored within the housing, the panel in that case being totally clear. The seats utilized in conjunction with the platform adapted to be removed from their housing and brought into active position above the plane of said panel.

The invention also relates to a modular platform for making a floor structure according to the specifications set forth hereinabove, said platform being characterized in that it is constituted by a horizontal panel and a plurality of seats adapted to be retracted into a housing provided below the upper plane of said horizontal panel, the horizontal panel constituting a flooring element of the premises, and the other components of the platform comprising a supporting framework formed by two box girders supporting said panel, the two girders forming two parallel, twin longitudinal elements, disposed on the two longer sides of said rectangular platform. Furthermore, the two box girders are separated by a gap which contains said mechanical means for vertically displacing the platform.

BRIEF DESCRIPTION OF THE DRAWINGS

The invention will be more readily understood on reading the following description with reference to the accompanying drawings, in which.

DETAILED DESCRIPTION OF THE INVENTION

Figure 1:
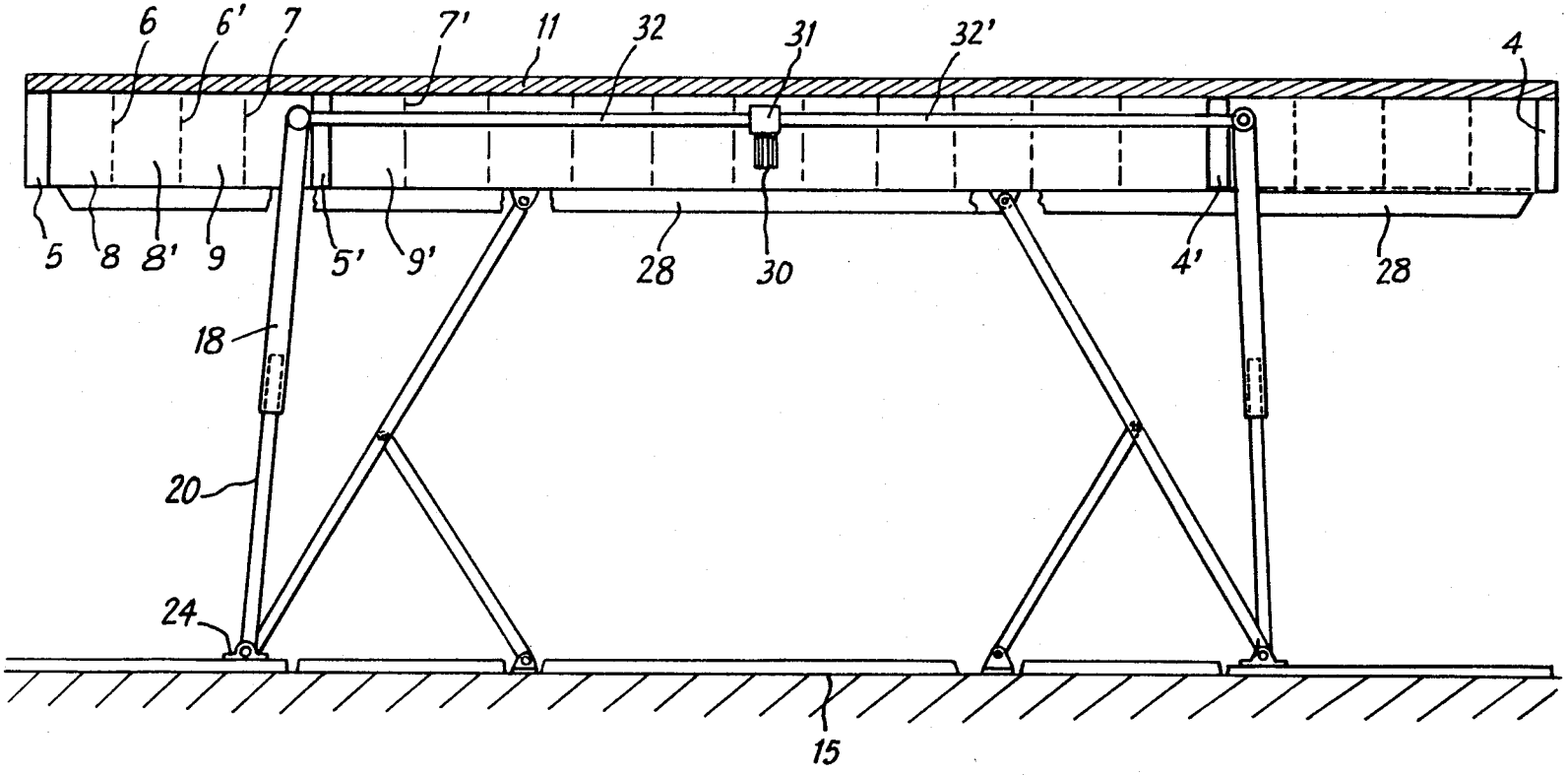
FIG. 1 shows a view in longitudinal section of the platform in high position.

Referring now to the drawings, each platform 1 comprises a supporting structure constituted by two twinned box girders 2 and 2' separated by a gap 3 of which the width is substantially equivalent to the width of the girders, with the result that the width of each platform is divided into three equal thirds.

Each platform is preferably much longer than large, the ratio between the length and the width preferably being greater than 10.

Each platform is provided to receive a row of plurality of aligned, retractable seats, as will be seen in detail hereinafter, the seats are preferably disposed inside at least one of the box girders.

The width of each platform thus corresponds to the width of a row of seats, increased by the space necessary between two rows of seats to allow passage and comfort of the audience or participants.

Figure 8:
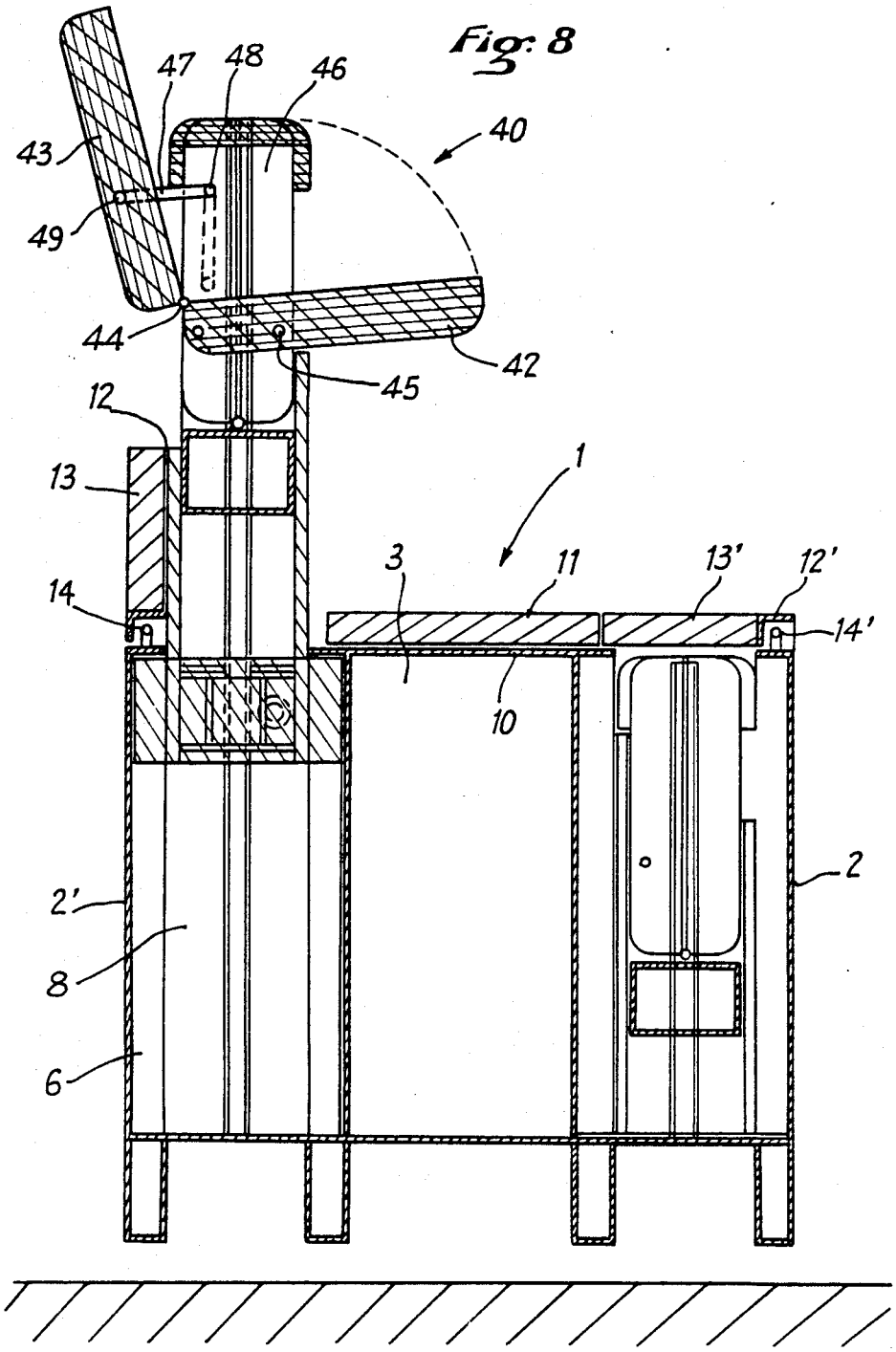
FIG. 8 shows a view in detail illustrating the seats of a row in active position.

According to the embodiment shown here, each platform is provided to receive at least one row of about twenty seats which are capable of being manoeuvred either separately or together, the whole row being displaced from its retracted position inside one of the box girders, towards an extended position as shown in FIG. 8.

Figure 2:
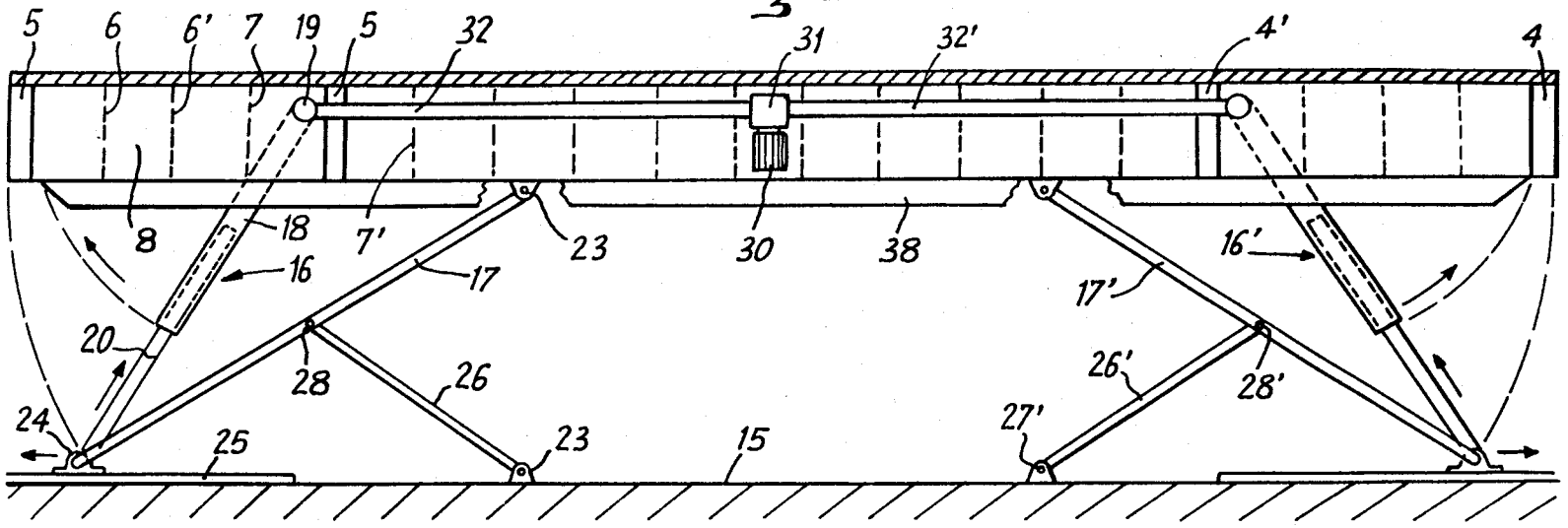
FIG. 2 shows a view in longitudinal section of the platform in intermediate position in its movement returning towards low position.
Figure 3:
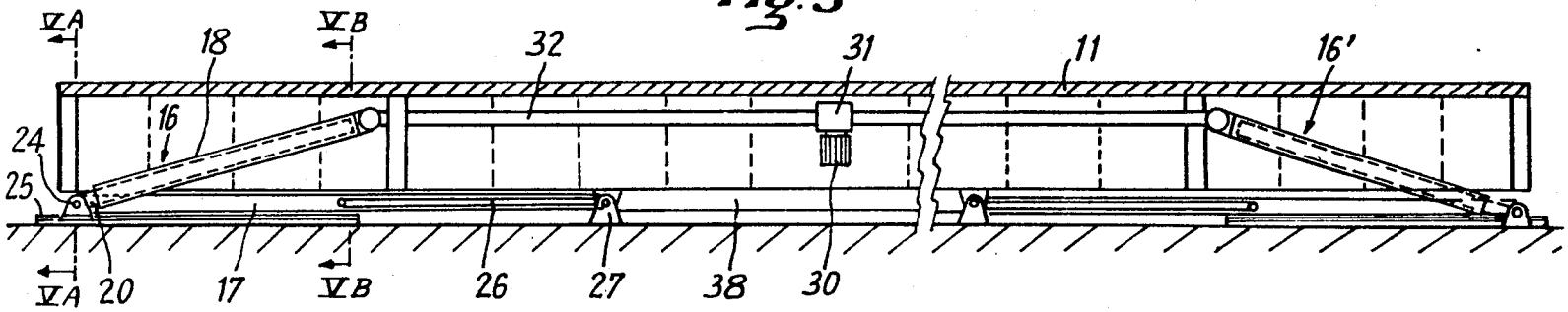
FIG. 3 shows a view of the platform brought into low position.

The basic structure of the platform constituted by the two box girders 2 and 2' is completed by bracing elements common to the whole of the platform and connecting the two box girders 2, 2'. For example, these braces 4, 4', 5, 5' may be disposed at the ends and at intermediate positions along the length of the platform, as shown in FIGS. 1, 2 and 3.

Each box girder 2, 2' is preferably constituted by a U-shaped metal sheet and also includes inner stiffener frames 6, 6', 7, 7' oriented perpendicular to the longitudinal axis of the box girders 2, 2' and fastened within the box girders along the length of the box girders which define therebetween modular housings 8, 8', 9, 9', each receiving a retractable seat 10, 10'.

The two box girders 2, 2' are joined in their upper part, at the level of the gap 3, by a plate 10 supporting the rectangular horizontal panel 11 disposed between the two box girders 2, 2' which may constitute the floor of the platform between adjacent rows of seats.

On the upper part of each box girder 2, 2', overlying the housings 8, 8', 9, 9' used for receiving the seats in retracted position, there is disposed a covering plate 12, 12' covered with a surfacing or flooring 13, 13' which comes level with the rectangular horizontal panel 11 which is disposed between the two box girders 2, 2'. As shown in FIG. 8, the covering plates 12, 12' are mounted to pivot about pivot pins 14, 14'.

Figure 5:
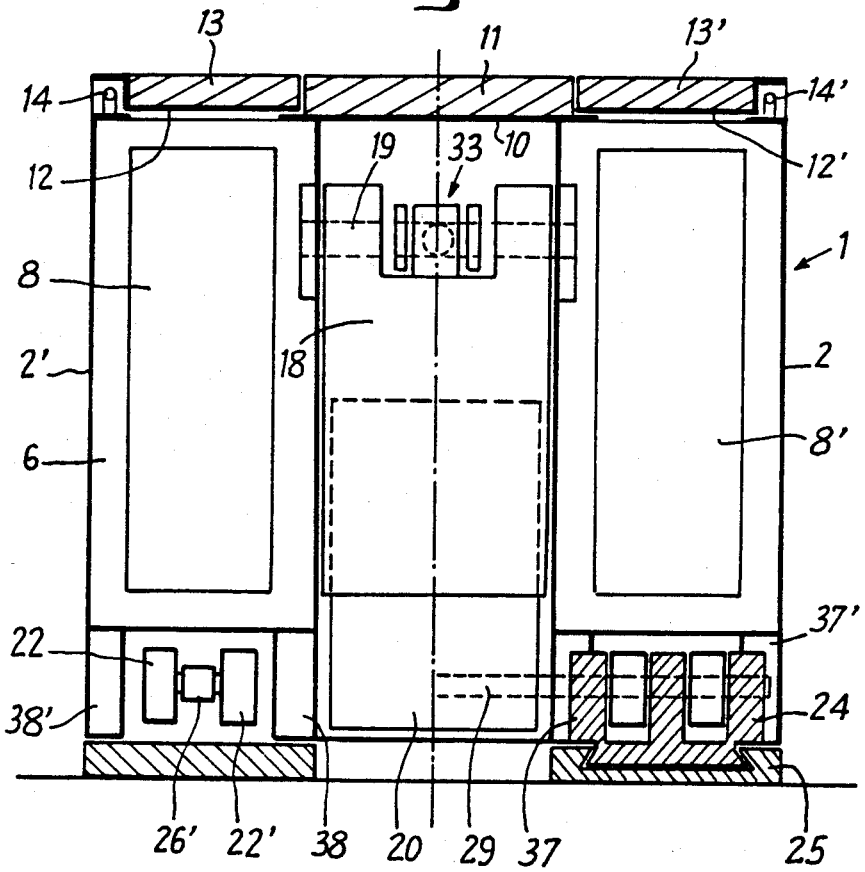
FIG. 5 shows a view in transverse section of the platform viewed, for the right-hand part of the Figure, at the level of the end of the platform, i.e. plumb with the shoe receiving the common swivel of the extensible leg element and tie rods (and along line VA—VA of FIG. 3), whilst, on the left-hand part of the Figure, the section is taken at the level of the position of the stabilizer (i.e. along line VB—VB of FIG. 3).

FIG. 5 in particular shows that, with the covers 12, 12' in closed position, the platform 1 offers on its upper surface a totally clear bare floor (the platform being able to provide this type of surface either when in high position or in low position).

According to an essential feature of the invention, the platform is mounted to move between a high position shown in FIG. 1 and the low position resting on the ground 15 as shown in FIG. 3, FIG. 2 showing the movement (in the direction of the arrows) and illustrating the lowering of the platform from its high position towards its low position.

The mechanical means used to produce the vertical displacement of the platform is preferably constituted by two extensible leg elements performing the function of extensible and retractable jacks; these two extensible leg elements 16 and 16' are each associated with a tie-rod 17, 17'.

According to the embodiment described and illustrated in each present specification, the extensible leg element 16, 16' is constituted by two elements; an upper element 18 which is pivotally attached at its upper end about an axis 19 between the two box girders 2 and 2' and a telescoping lower element 20 is mounted for telescopic slide.

The tie-rod 17, 17' which might be constituted by a unitary element is, in the present embodiment, constituted by two twinned pairs of rigid elements. For example, as shown in FIG. 4 metal tubes of quadrangular section 21, 21', 22, 22', respectively, disposed in pairs respectively on either side of the extensible leg element 16 may serve as the tie-rod 17, 17'.

The tie-rod 17, 17' (constituted by the four elements 21, 21', 22, 22') is articulated under the two box girders 2, 2' about pivot pin 23.

Figure 4:
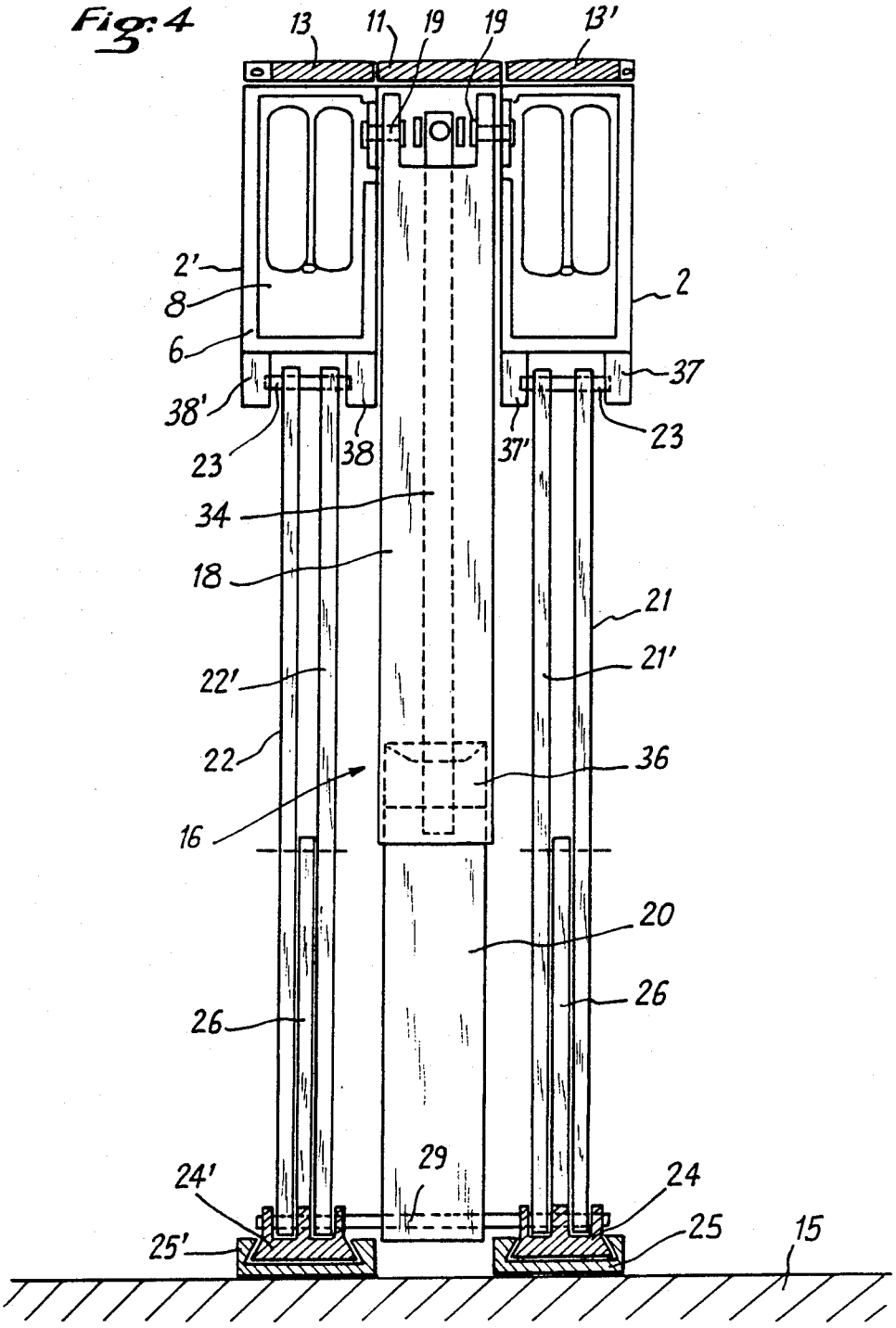
FIG. 4 shows a view in lateral elevation of the platform.

As best seen in FIG. 4, the lower end of the lower element 20 of the extensible leg element 16 and the lower end of the tie-rod 17 are furthermore joined at their base by a common pivot pin 29.

More especially and in accordance with the embodiment described and illustrated at present, the two pairs 21, 21' and 22, 22', respectively of the elements constituting the tie-rod are pivotally mounted on two sliding shoes 24 and 24', these shoes being adapted to smoothly move within slideways or rails 25, 25', resting on the ground 15.

As best seen in FIG. 2, each pair and 22, 22', respectively, of the elements used of form the tie-rod 17, 17' is associated with a stabilizer 26, 26', itself pivotally mounted on one side to a fixed base 27, 27' and articulated pivotally mounted at 28, 28' at its opposite end substantially at the centre of the tie-rod 17, 17' the stabilizer 26 having a length equivalent to about half that of the tie-rod 17, 17' with the result that the stablilizer 26, 26' forms with the lower half of the tie-rod 17, 17' a isosceles triangle of which the articulation 28, 28' occupies the apex. This relationship between the stabilizers 26, 26' and the lower halves of the tie-rods 17, 17' remains constant even when the sliding shoes 24, 24' move.

It will be readily appreciated that the sliding shoes 24, 24' will preferably be provided with outer faces made of materials having a low coefficient of friction, and furthermore the exposed surfaces of the rails 25, 25' within which the sliding shoes 24, 24' will preferably, likewise be provided with coatings for smooth having a low coefficient of friction clearly, however, this system may be replaced by an assembly provided with rollers or rolling means likewise guided in a corresponding rail system.

In the assembly of the box girders 2, 2', the extensible leg elements 16 and 16', the tie-rods formed by the members of sections 21, 21' and 22, 22', as well as the stabilizers 26, 26', and the rails or slideways 25, 25', are all parallel to one another and are all disposed along the longitudinal axis of the platform.

The mechanical means for vertically displacing the platform is preferably constituted by a single motor 30 disposed substantially at the centre of the platform and in the inner gap 3 separating the two box girders 2, 2'; this motor 30 is associated with a reduction gear 31. As best seen in FIG. 2, a pair of colinear shafts 32, 32' on either side are disposed and are disposed in diametrically opposite directions of the reduction gear 31.

Figure 6:
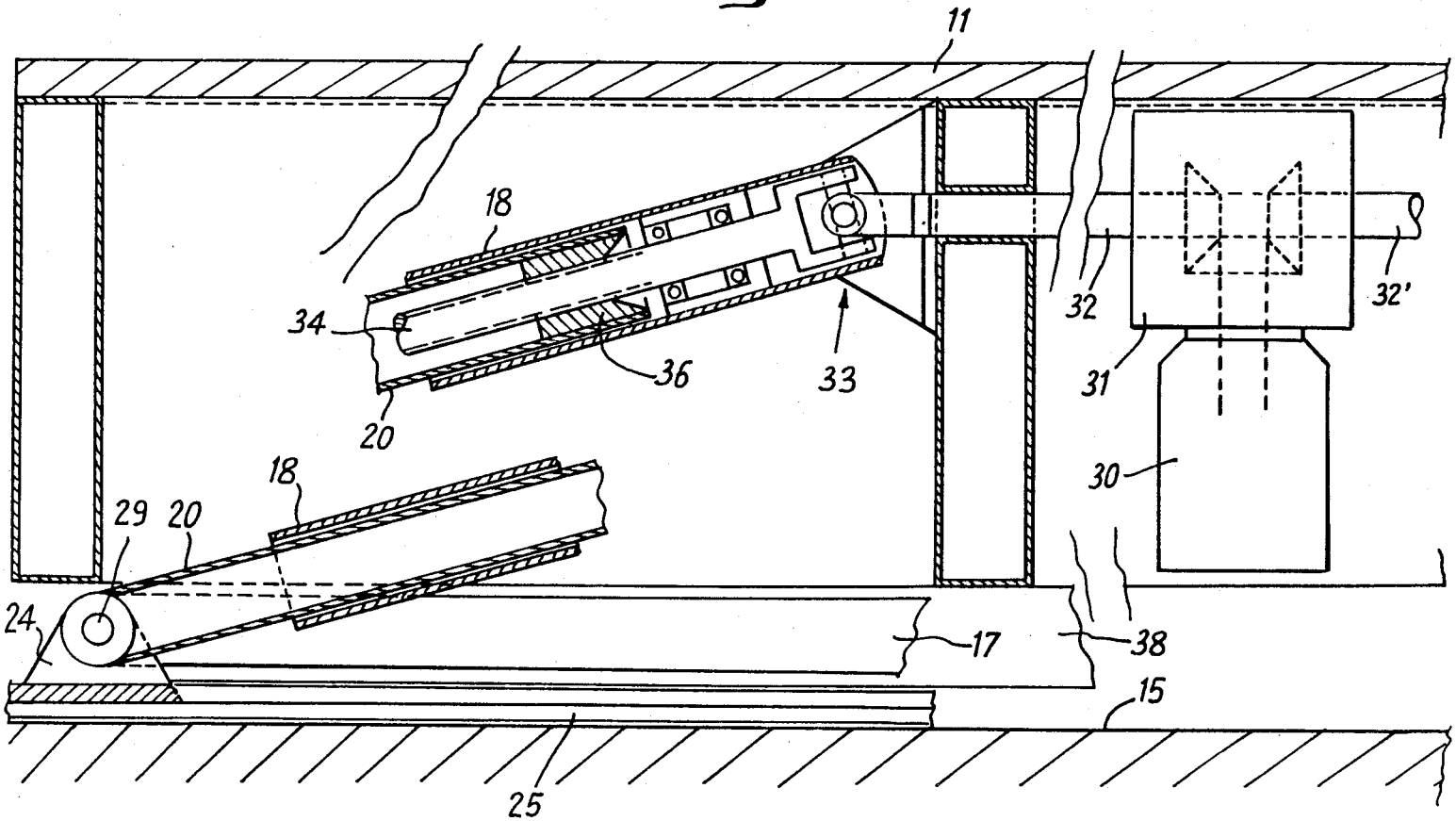
FIG. 6 shows a view in detail with parts torn away, showing the position and operation of the extensible leg element shown with the platform in low position.
Figure 7:
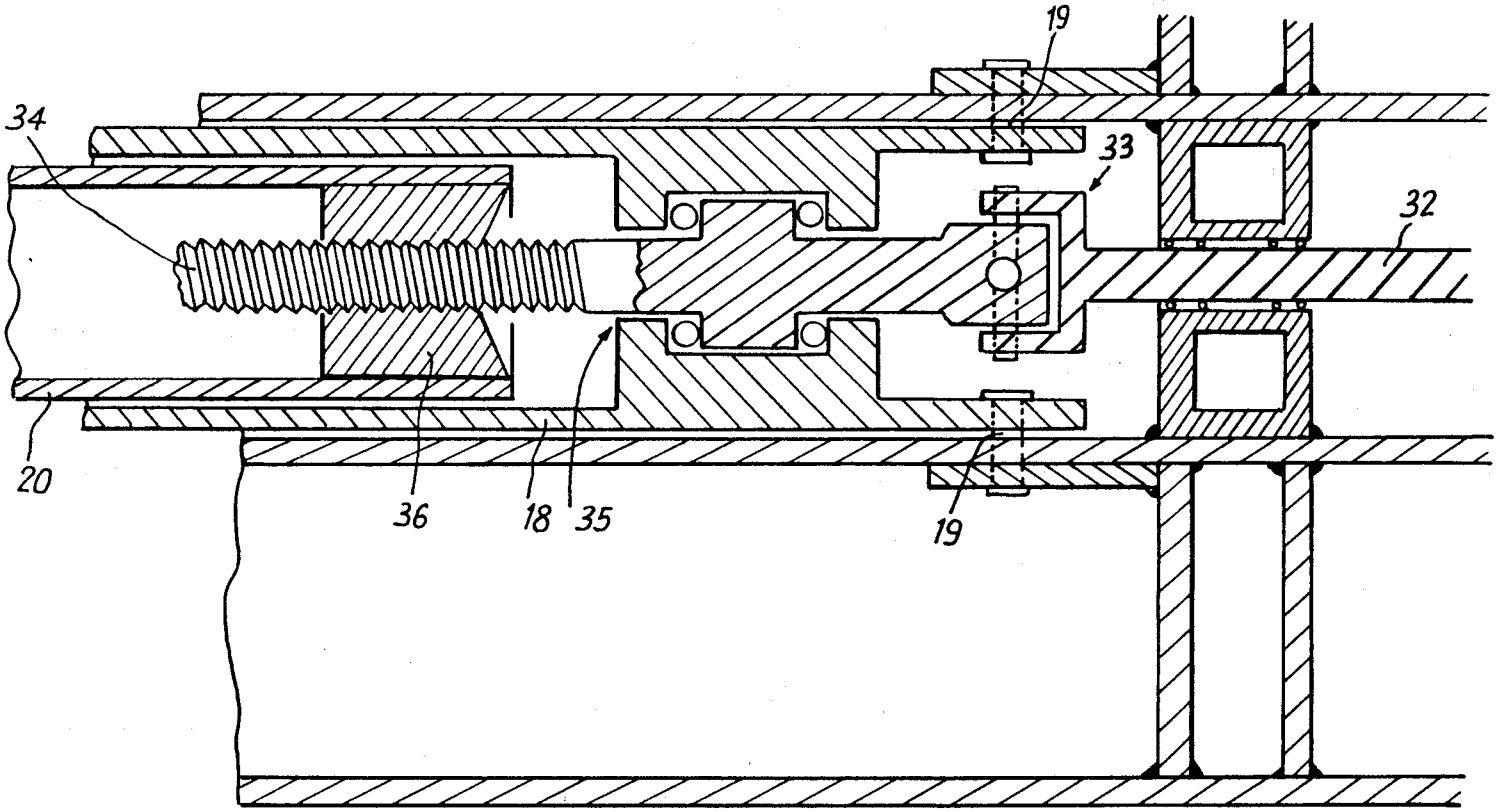
FIG. 7 shows a view in detail of the mechanisms used in the transmission of the movement for controlling retraction of the leg element.

FIGS. 6 and 7 in particular show that the shaft 32 preferably terminates at and is connected to a Universal joint 33 having an axis (crosswise) which is colinear with the axis 19 defined by the attachment of the upper end of the upper element 18 of the extensible leg element 16 and the two box girders 2, 2'.

The Universal joint 33 allows transmission of the movement from the shaft 32 to the rotational threaded rod 34 which is mounted to rotate inside the telescopic element 18 of the extensible leg element 16.

As is best seen in FIG. 7, the threaded rod 34 is mounted to rotate without being able to move longitudinally, being immobilized by the set of bearings formed by opposite thrust ball bearings 35.

The threaded rod 34 is inserted in a bronze block 36 help immobile within the upper end of the lower telescopic element 20 of the extensible leg element 16, the bronze block 36 constituting a captive nut driven in longitudinal displacement along threaded rod 34 by the rotation of the threaded rod 34.

It will be readily understood that, under these conditions, the rotation of the threaded rod 34 produced by the motor 30, via the shaft 32 and the Universal joint 33, will produce the movement of extension or of retraction of the extensible leg elements 16, 16' (depending on the direction of rotation of the screw 34).

The drive of the two extensible leg elements 16, 16', by a common motor, ensures in original and particularly efficient manner, the perfect synchronism of the actuation of the two right and left extensible leg elements 16 and 16' respectively, consequently ensuring the raising or lowering movement of the platform, and furthermore ensuring that the platform 1 will remain constantly horizontal and parallel to the ground during this raising and lowering.

The movement of displacement of the platform between its high position and its low position is illustrated in FIG. 2 which shows that, as a function of the retraction (or, inversely, of the extension during the opposite movement) of the extensible leg elements 16', the sliding shoes 24, 24' held captive inside the guide rails 25, 25' move in a centrifugal direction towards the ends of the guide rails 25, 25', as the platform assembly lowers.

However, the conjunction of the two pairs of lateral tie-rods 21, 21', 22, 22' respectively, captive at their lower ends by sliding shoes 24, 24' and consequently fast with the ground 15, allows perfect lateral stability of the whole of the platform 1 resting on the extensible leg elements 16, 16'.

Furthermore, as best seen in FIG. 1, the positioning of extensible leg elements 16, 16' along the platform, at intermediate levels, allows balancing and homogeneous distribution of the bending forces, consequently allowing for the use of a platform of long length.

In low position, as shown in FIGS. 3 and 5, the platform assembly rests on the ground via lower sections 37, 37', 38, 38', respectively, disposed parallel to the length of, and beneath each of the box girders 2, 2'.

As best seen in FIGS. 2 and 3, each end of, the lower sections 37, 37', 38, 38' is bevelled, thereby allowing for the insertion of the sliding shoes 24, 24' within the guide rails 25, 25', the platform in totally lowered position.

The lower sections 37, 37', 38, 38' transfer, in places and in homogeneous and regularly distributed manner, the forces likely to be received in the event of considerable loads being applied on the platform in low position.

In fact, the sections 37, 37', 38, 38' rest on the ground 15 either directly or, as in the embodiments described here, as best seen in FIGS. 2 and 3, via rails 25, 25'.

To that end, in one embodiment, the rails 25, 25', having a length corresponding to the useful stroke of the sliding shoes 24, 24', might be embedded in the ground 15.

According to a variant embodiment, these rails 25, 25' may be elevated, whilst resting on the ground; in that case, the rails are extended, outside their active part, by support elements extending the rails and adapted to receive, in their position of rest, sections 37, 37', 38, 38'.

It is seen from the left-hand part of FIG. 5 that, in this position of rest, when the platform 1 has been lowered, the two twinned elements forming a pair belonging to the tie-rod 17, 17', i.e. the tubular elements 22, 22', are positioned inside of the space defined by the two lower sections 38, 38', whilst the stabilizer 26' is itself positioned between the two tubes 22, 22', the assembly then being in horizontal position as shown in particular in FIG. 3.

As shown in FIG. 8, each of the box girders 2, 2', having disposed therein the housings 8, 8', 9, 9' preferably receives a plurality of seats 40, each seat being constituted by a module adapted to be displaced in height between a retracted position inside the housing (within the box girder) and the high extended position as shown in the left-hand part of FIG. 8.

According to a particular feature of the invention, the platform thus comprises two rows of seats disposed respectively in one and the other of the two box girders, the seats being disposed face to face; whereby it is thus possible to place one row of seats or the other in active position, thus making it possible to use the hall in multiple ways, the centre of interest thus lying at one end or at another; in either case the seats may be placed in active position so as to face the event.

It is thus possible to arrange in the same hall, at two opposite ends, equipment corresponding to totally different events, each set of equipment being fixed; the hall may be used in one direction or in another.

According to a more particular feature, each module constituting a unitary seat 40, capable of being extended vertically from its housing, 8, 8', 9, 9' is itself constituted by an assembly in which the seat 42 and the backrest 43 are connected together about a common horizontal hinge 44 located at the base of the backrest 43. The seat 42 is itself mounted to pivot about a horizontal pivot pin 45, which connects the two lateral armrests 46 (forming part of the displaceable module). The backrest 43 is itself connected on each side to each of the lateral armrests 46 by a connecting rod 47 connected, on the one hand, at 48 to the armrest and at 49 to the backrest 43. Under these conditions, the pivoting of the seat 42 about the horizontal pivot pin 45 brings about the opening/-closure movement of the chair 40 by angular approach of the seat 42 and the backrest 43, whilst the connecting rod 47 automatically controls tipping of the whole seat 40 towards a vertical, compact position, the two elements (i.e., the seat 42 and backrest 43) being returned against each other when in the retracted position inside the housing 8, 8', 9, 9' constituted within the box girder 2, 2'.

In a preferred embodiment, all of the motorization means constituted in particular by motor 30 equipping each of the platforms, as well as the motors (not shown) controlling the movement of elevation and retraction of the seats 40, may be connected in conventional manner by electrical circuits to a central station, from which the movement of elevation or of lowering of each platform and the movement of elevation or of positioning of each seat 40 or each row of seats, may be remotely controlled.

Under these conditions, it is possible, from a central position, to control the individual positioning of each of the platforms in order to modulate the configuration of the hall as required.

It is thus possible to pass from the low position of all the platforms, where the floor is totally clear, to and elevated position where the platforms may be disclosed in tiers corresponding to the required position or configuration of the hall.

It will be readily appreciated that this system allows considerably flexible design, positioning and implantation of a structure when organizing a show or an event.

If it is desired to use the hall with the modular platforms 1 in low position, on bare ground, all the girders 2, 2' resting directly on the ground 15 via the lower sections 37, 37', 38, 38', a particularly resistant foundation is obtained, allowing in particular the circulation of lifting machines (trucks, transporters, . . . ). It is thus possible to bring into a large hall elements for forming an internal structure useful in the case of using the hall for an exhibition.

Modifications may then be made very rapidly by simple remote-control for individually actuating each platform to the desired height and automatically stabilized the platform 1 in its position, each platform remaining parallel to the ground 15 and stable in any position, its positioning in space being controlled in stable manner by the stabilizers 26, 26' which each have one anchored to the ground.

Figure 9:
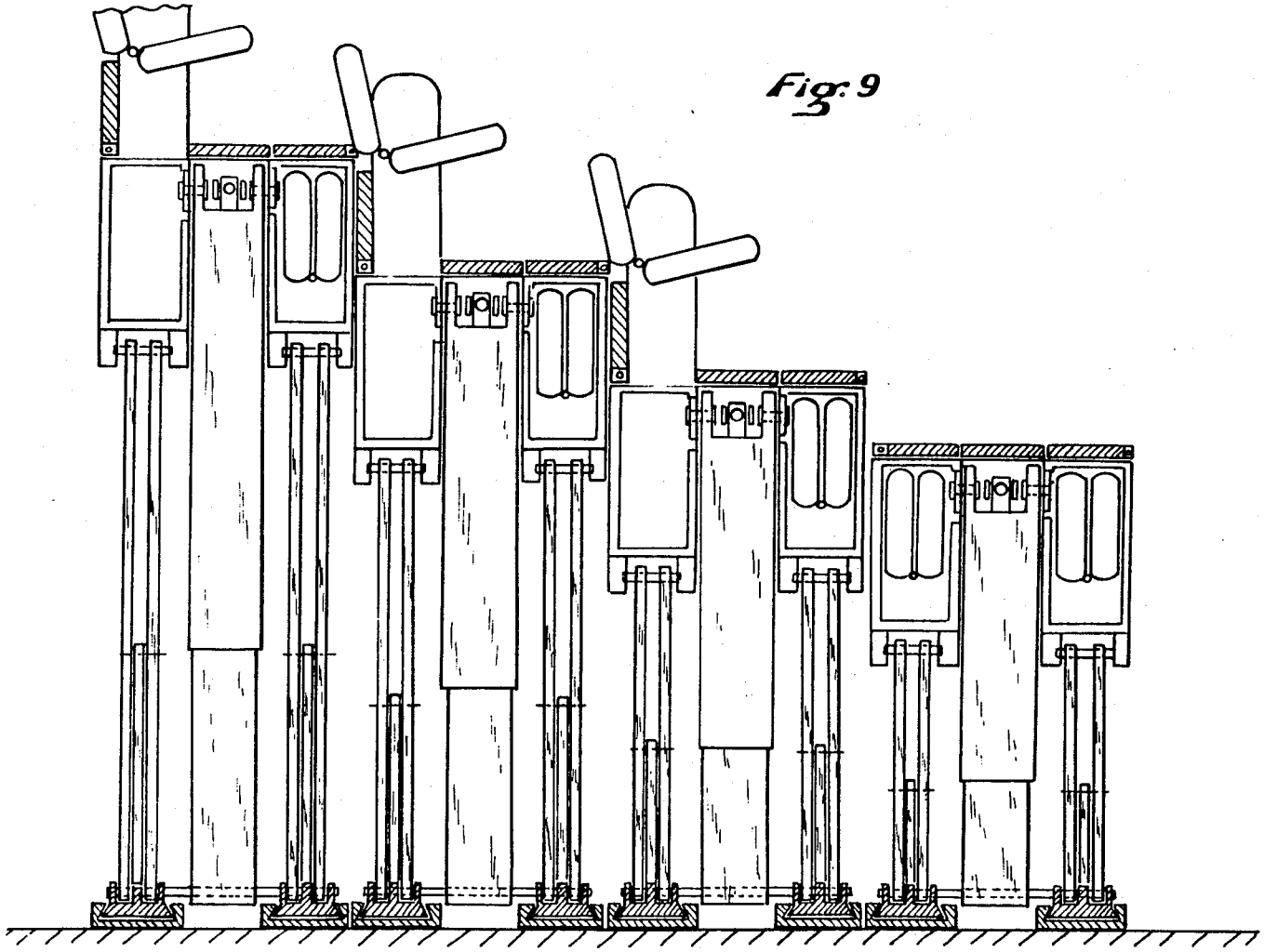
FIG. 9 shows a plurality of platforms side by side and disposed in tiers, the platforms shown in transverse view.
Figure 10:
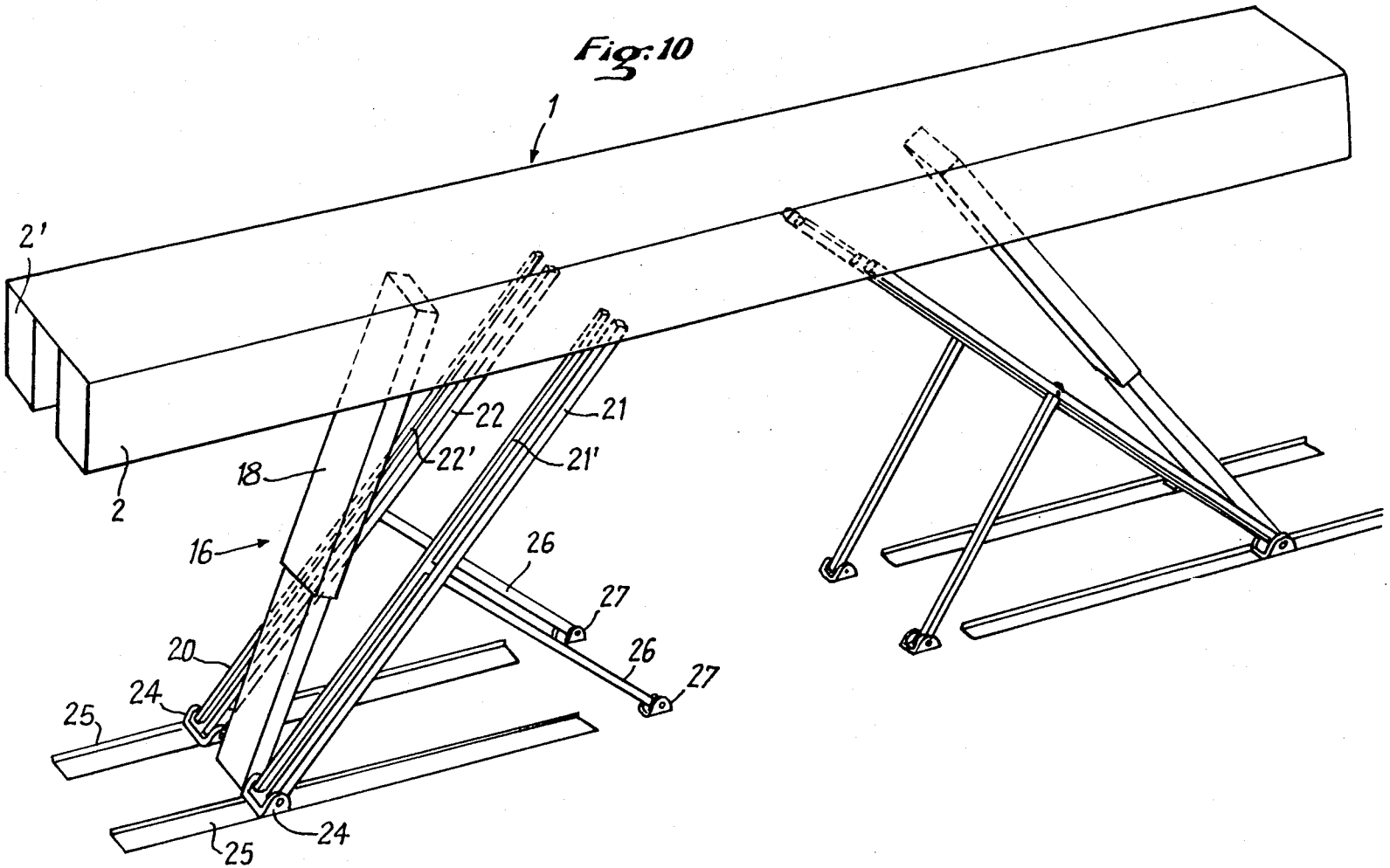
FIG. 10 shows a view in perspective of a platform in high position.

Tiers may therefore be formed (as shown in FIG. 9), in any geometrical configuration or angle, allowing in particular two halves of the hall to face each other mutually, the audience looking towards the centre, or, on the contrary, the whole of the hall facing a spectacle taking place on one side or the other.

It will be readily appreciated that the extension and positioning of the seats 40 in their active position may be effected in various ways.

A preferred embodiment has been more especially described in the foregoing specification and illustrated in the accompanying drawings, in which the seats are displaceable vertically, being extended from each box girder 2, 2' in a vertical upward movement after the covering plate 12, 12' and corresponding flooring 13, 13' have been pivoted about the pivot pins 14, 14'. Alternate embodiments may also be provided in which the rows of seats 40 mounted fast inside each box girder 2, 2' may be extended laterally through one or the other or through both lateral sides of the box girders 2, 2', the extended rows of one box girder belonging to one platform then being brought into active position above the adjacent platform 1 previously brought to an appropriate level for this purpose.

Another variant embodiment may also be made in which the rows of seats 40, are extended through an openable face of one or both box girders 2, 2', the rows of seats then being brought, after extension from a platform, above the adjacent platform brought to a lower level so that the horizontal panel of this adjacent platform comes at the level of extension of the row of seats.

What is claimed is:

1. A modifiable floor structure for a public hall or premises, said modifiable floor structure comprising a plurality of modular platforms, whereby said modifiable floor structure allows a space within said public hall or premises to be adapted and optimized for varying events, each of said modular platforms, comprising:

(a) a plurality of rectangular horizontal panels, each of said panels having two longer sides and two shorter sides;

(b) a supporting framework formed by two rectangular box girders each having two longer sides and two shorter sides, said girders being attached to and supporting said rectangular horizontal panels, the two box girders being disposed in parallel along the two longer sides of said platform, said girders being separated by a gap;

(c) mechanical means provided within said gap for vertically displacing said modular platform, whereby during said vertical displacement said modular platform remains horizontal;

(d) a plurality of foldable seats;

(e) a plurality of housings disposed within said box girders, each housing being adapted to contain at least one seat in folded position, said seats being adapted to be removable from said housing and brought into active position above the plane of said panels, said housings also being adapted such that when said chairs are folded and stored within said housing said modular platform will be totally clear.

2. The modular platform according to claim 1 wherein each of said box girders comprises:

(a) a U-shaped metal sheet, said U-shaped metal sheet having two spaced-apart upturned sides, a bottom side joining together said pair of upturned sides and an open uppermost side, whereby the space between said pair of spaced-apart upturned sides defines the interior of said U-shaped metal sheet and whereby a housing for receiving said plurality of retractable seats is formed within said interior or said U-shaped metal sheet;

(b) a plurality of quadrangular stiffening frames for stabilizing said box girders and holding apart said pair of upturned sides of said U-shaped metal piece, said stiffening frames disposed transversely in a spaced-apart fashion along the length of said box girder.

3. A modular platform according to claim 2 wherein said gap separating said pair of box girders has a width which is substantially equal to the width of each of said box girders and said mechanical means for vertically displacing said modular platform comprises:

(a) two extensible and retractable leg elements for joining together said modular platform and the surface upon which said modular platform rests, each of said leg elements having two ends, an upper end joined to said modular platform and a lower end joined to the surface upon which said modular platform rests;

(b) a pair of first pivot pins, one of said pair of first pivot pins being operably connected to each of said pair of extensible leg elements for joining the upper ends of said leg elements to said modular platform;

(c) mechanical means for actuating the extension and retraction of said leg elements;

(d) a pair of tie-rod means, one of said pair of tie-rod means being operably connected to each of said extensible and retractable leg elements for augmenting the stabilization of said modular platform, the lower end of each of said pair of tie-rod means being connected to the lower end of one of said extensible leg elements, the upper end of each of said tie-rod means being connected to said modular platform by means of a second pivot pin, parallel to, but not collinear with, said first pivot pin.

4. The modular platform according to Claim 2 wherein said housings for enclosing said plurality of chairs while said chairs are disposed in a folded position within said U-shaped metal sheet are divided by adjacent members of said plurality of quadrangular stiffening frames, such that a plurality of individual housings each suitable for enclosing one of said folded chairs are formed, said housings further including at least one covering plate, said covering plate disposed across said open, uppermost side of said U-shaped metal sheet, said covering plate being pivotally attached to one of said two longer sides of said rectangular box girders at the upper edge of one of said upturned sides of said U-shaped metal sheet.

5. The modular platform according to Claim 2 wherein said mechanical means for vertically displacing said modular platform comprises an electric motor with a reduction gear, said motor being disposed in central position both within the gap between said two box girders and with respect to the length of said modular platform, and said mechanical means further comprising:

(a) two driven shafts disposed along the longitudinal axis of said modular platform, each of said shafts having a first and a second end, said first end of each of said shafts being operably connected to said reduction gear, whereby said second ends of said shafts are disposed at opposite ends of said modular platform;

(b) a pair of universal joints, one each of said pair of universal joints being operably connected to said second ends of said shafts, whereby said pair of universal joints are disposed at opposite ends of said modular platform;

(c) a pair of threaded rods, one of said pair of threaded rods operably connected to each of said universal joints, each of said threaded rods located inside of one of said extensible leg elements, whereby said threaded rods are driven in rotation by said universal joints, whereby the rotation of said shafts is transformed into the movement of extension or retraction of said extensible leg elements.

6. The modular platform according to claim 2 wherein each of said two extensible and retractable leg elements comprises:

(a) an upper and a lower tubular element, said lower tubular element having a lower end which is pivotably connected to the surface upon which said modular platform rests and said upper tubular element forming a sleeve and said lower tubular element telescopically sliding into said upper tubular element; and, (b) a captive nut disposed with said lower tubular element, said captive nut being adapted to receive one of said threaded rods whereby the rotating movement produced by said motor and transferred to said threaded rods may be employed to effect the movement of extension or retraction of said leg elements, thereby varying the height of said platform.

7. The modular platform according of claim 2 wherein each of said pair of tie-rod means is associated with a stabilizer, said stabilizer comprising a connecting rod, one end of said stabilizer being pivotably connected to the surface upon which said modular platform rests and the opposite end of said stabilizer being pivotably connected to one of said tie-rod means, whereby said pair of stabilizers, each associated with one of said pair of tie-rod means are disposed parallel to the longitudinal axis of said modular platform.

8. The modular platform according to claim 7 wherein said lower ends of said lower tubular elements are each joined to said lower end of said tie-rod means which is associated therewith, whereby each of said extensible leg elements are pivotally mounted together with a corresponding one of said lower tubular elements within a shoe which is slidable engaged within a slideway, said slideway being fastened to the surface upon which said modular platform rests and disposed parallel to the longitudinal axis of the modular platform, whereby the lower ends of said lower tubular elements, said lower ends of said extensible leg elements and the lower ends of said extensible leg elements and the lower ends of said tie-rod means may move along the length of said slideway as said modular platform moves.

9. The modular platform according to claim 2 wherein each of said tie-rod means comprises two pairs of legs, said legs disposed parallel to each other, each pair of legs being operably connected to one of said stabilizers such that said stabilizer is disposed in intermediate position between the two legs of each of said pairs of legs.

10. The platform according to claim 2 wherein the extensible leg elements, tie-rod means and stabilizers are adapted to be displaced between:

(a) a position of rest corresponding to the low position of the platform, wherein the tie-rod means and the stabilizer are disposed in a parallel arrangement, one against the other, and substantially in the same horizontal plane, while the extensible leg elements lie in a plane which forms a non-zero angle with the horizontal, sufficient to limit the break-away forces necessary for raising said modular platform, and (b) a position of maximum extension corresponding to the high position of the platform, wherein the extensible leg elements lie in a plane close to the vertical, but forming a non-zero angle with the vertical, whereby said modular platform remains substantially horizontal and level during said displacement.

11. The modular platform according to claim 2 wherein each of said pair of box girders within said modular platform constitutes the housing for a row of seats, each row being retractable and foldable inside of its housing and capable of being brought into extended position above the upper plane of said modular platform, the seats of one row facing a direction opposite the adjacent row, thus making it possible, from the same platform, to make a row of seats facing one direction, or facing an opposite direction.

* * * * *